US007530562B2

(12) United States Patent
Ohshima et al.

(10) Patent No.: US 7,530,562 B2
(45) Date of Patent: May 12, 2009

(54) SHEET FEEDING APPARATUS AND IMAGE FORMING APPARATUS

(75) Inventors: Minoru Ohshima, Kanagawa (JP); Kazuyuki Tsukamoto, Kanagawa (JP); Shin Takeuchi, Kanagawa (JP)

(73) Assignee: Fuji Xerox Co., Ltd., Tokyo (JP)

( * ) Notice: Subject to any disclaimer, the term of this patent is extended or adjusted under 35 U.S.C. 154(b) by 249 days.

(21) Appl. No.: 11/601,818

(22) Filed: Nov. 20, 2006

(65) Prior Publication Data

US 2007/0262511 A1 Nov. 15, 2007

(30) Foreign Application Priority Data

May 15, 2006 (JP) ..... 2006-135273

(51) Int. Cl.
*B65H 3/52* (2006.01)

(52) U.S. Cl. ..... 271/122; 271/124; 271/125

(58) Field of Classification Search ..... 271/122, 271/124, 125
See application file for complete search history.

(56) References Cited

U.S. PATENT DOCUMENTS 4,822,023 A * 4/1989 Miyoshi ..... 271/118
5,316,285 A * 5/1994 Olson et al. ..... 271/122
5,655,762 A * 8/1997 Yergenson ..... 271/121
5,882,004 A * 3/1999 Padget ..... 271/119
6,059,281 A * 5/2000 Nakamura et al. ..... 271/119
6,168,146 B1 * 1/2001 Komuro et al. ..... 271/10.12
6,308,947 B1 * 10/2001 Kojima et al. ..... 271/124
6,520,497 B2 * 2/2003 Tamura ..... 271/122
6,824,132 B2 * 11/2004 Asai et al. ..... 271/125
6,877,738 B2 * 4/2005 Sonoda et al. ..... 271/121
7,007,945 B2 * 3/2006 Hiramitsu et al. ..... 271/125

FOREIGN PATENT DOCUMENTS

JP 3-272923 12/1991
JP 7-223750 8/1995

* cited by examiner

*Primary Examiner*—David H Bollinger
(74) *Attorney, Agent, or Firm*—Morgan, Lewis & Bockius LLP

(57) ABSTRACT

A sheet feeding apparatus includes a transport unit that transports a recording sheet from a storage unit, a separation unit, when stacked plural recording sheets are transported by the transport unit, separates a first recording sheet from the other recording sheets, and a push-back unit that can pivot from a separation action point to an end point of the storage unit and that pushes back ends of the other recording sheets to the storage unit during transport of the first recording sheet by applying to the other recording sheets a larger force in the direction opposite to the transport direction than a force applied to the other recording sheets in the transport direction, at a same time by applying to the first recording sheet a smaller force in the direction opposite to the transport direction than a force applied to the first recording sheet in the transport direction.

12 Claims, 10 Drawing Sheets

SHEET FEEDING APPARATUS AND IMAGE FORMING APPARATUS

BACKGROUND

1. Technical Field

The present invention relates to a sheet feeding apparatus that separately transports sheets one by one, and an image forming apparatus equipped with this sheet feeding apparatus.

2. Related Art

In image forming apparatuses employing an electrophotographic system or an inkjet system, generally a bundle of sheets, in which multiple recording sheets are stacked, is set in a sheet tray, and from this sheet bundle recording sheets are transported one by one in a separated state to an image forming portion. However, in some instances, a phenomenon occurs in which due to frictional force produced between recording sheets, a second or subsequent recording sheet is fed together with the first recording sheet, so that two or more recording sheets are transported at the same time (so-called multi-feeding).

SUMMARY

According to an aspect of the invention, a sheet feeding apparatus includes a transport unit that, among plural recording sheets loaded in a storage unit, transports at least a first recording sheet disposed at an uppermost position in the storage unit; a separation unit, provided downstream of the transport unit in a transport direction that, when the first recording sheet and one or more other recording sheets are stacked and transported out of the storage unit by the transport unit, causes downstream ends of the other recording sheets in the transport direction locate at a separation action point in a transport path, the separation action point being a contact point between the transport unit and the separation unit, by applying to the other recording sheets a larger force in a direction opposite to the transport direction by the separation unit than a force applied to the other recording sheets in the transport direction by the transport unit, while applying to the first sheet a larger force in the transport direction by the transport unit than a force applied to the first recording sheet in a direction opposite to the transport direction by the separation unit and; and a push-back unit that can pivot from the separation action point to a downstream end portion of the storage unit in the transport direction, and pushes back the downstream ends of the other recording sheets to the downstream end portion of the storage unit by applying to the other recording sheets a larger force in the direction opposite to the transport direction by the push-back unit than a force applied to the other recording sheets in the transport direction by the transport unit and the separation unit, while applying to the first recording sheet a smaller force in the direction opposite to the transport direction by the push-back unit than a force applied to the first recording sheet in the transport direction by the transport unit and the separation unit.

BRIEF DESCRIPTION OF THE DRAWINGS

Exemplary embodiments of the present invention will be described in detail based on the following figures, wherein.

DETAILED DESCRIPTION

Figure 1:
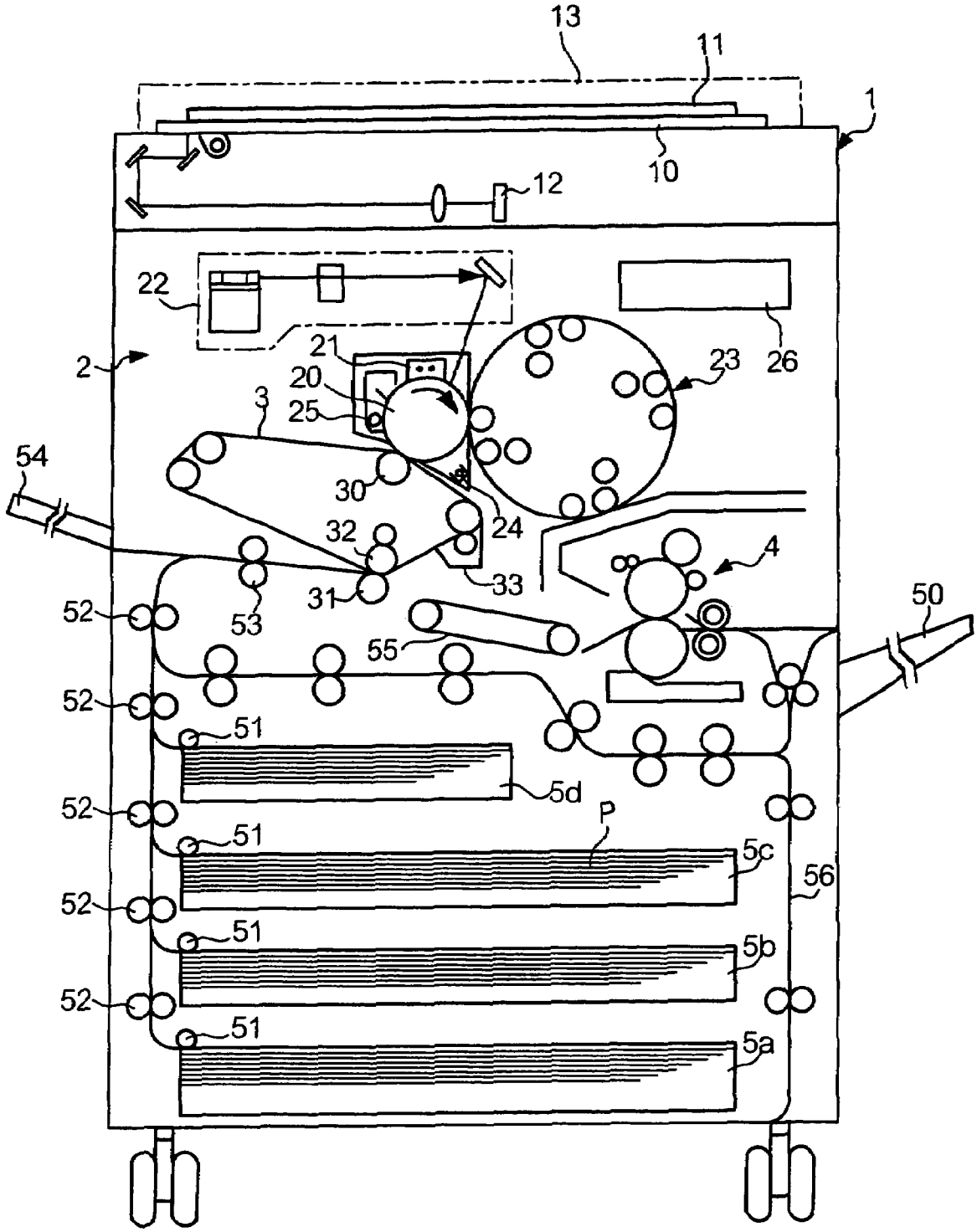
FIG. 1 shows an image forming apparatus that is applicable to the sheet feeding apparatus according to the exemplary embodiments.

FIG. 1 is a cross-sectional view that shows the configuration of a digital color copy machine that is an image forming apparatus equipped with a sheet feeding apparatus according to an exemplary embodiment of the present invention. This copy machine includes an image input portion 1 that optically captures an image of an original 11 placed on a glass platen 10 and converts that image to electrical image data with a CCD sensor 12, and an image forming portion 2 that forms an image on a recording sheet P based on the image data transferred from the image input portion 1.

The image forming portion 2, forms an image on the recording sheet P by, after forming a toner image on a photosensitive drum 20 based on the image data transferred from the image input portion 1, performing primary transfer of that toner image to an endless transfer belt 3, and further performing secondary transfer of the toner image on the transfer belt 3 to the recording paper P. The recording sheet P onto which a toner image has been secondarily transferred is discharged onto a discharge sheet tray 50 via a fixer 4. More specifically, the photosensitive drum 20 rotates at a predetermined process speed in the direction of the arrow, and on the perimeter of the photosensitive drum 20 are disposed a charging colotron 21 that uniformly charges the surface of the photosensitive drum 20 to a predetermined background potential, a laser beam scanner 22 that forms an electrostatic latent image on the photosensitive drum 20 by exposing the photosensitive drum 20 to light with a laser beam modulated based on the image data, a rotary development unit 23 that has developers of each color black, yellow, magenta, and cyan, and develops the electrostatic latent image on the photosensitive drum with any of the developers, a transfer preprocessing colotron 24 that removes the potential on the photosensitive drum 20 prior to primary transfer of the toner image to the transfer belt 3, and a cleaner 25 that removes residual toner on the photosensitive drum 20 after primary transfer of the toner image is finished.

The transfer belt 3 rotates around multiple rollers in the direction of the arrow, so that toner images of each color successively formed on the photosensitive drum 20 are transferred as multiple images to the transfer belt 3, and then the toner images are secondarily transferred together from the transfer belt 3 to a recording sheet P. A primary transfer roller 30 that forms a transfer electrical field between the primary transfer roller 30 and the photosensitive drum 20 is disposed at a position facing the photosensitive drum 20 so as to sandwich the transfer belt 3, and additionally a secondary transfer roller 31 and a facing electrode roller 32 are disposed so as to sandwich the transfer belt 3, and the recording paper P is inserted between the secondary transfer roller 31 and the transfer belt 3 and receives transfer of a toner image. Also, in the rotational path of the transfer belt 3, between the secondary transfer position and the primary transfer position, a belt cleaner 33 is provided that removes paper dust and residual toner from the surface of the transfer belt 3 after secondary transfer is finished.

Four levels of sheet trays 5*a* to 5*d* storing recording sheets P of different sizes are provided below the image forming portion 2. A recording sheet P of an appropriate size according to the size of the original detected by the image input portion 1 is fed out from any of the sheet trays 5 to the image forming portion 2 by a pickup roller 51. Multiple sheet transport rollers 52 are disposed in the transport path of the recording sheet P from each of the sheet trays 5*a* to 5*d* to the toner image secondary transfer position. A registration roller 53 is disposed on the upstream side of the secondary transfer position in the transport direction. The registration roller 53 feeds the recording sheet P fed out from the sheet trays 5*a* to 5*d* into the secondary transfer position at a predetermined timing synchronized with the timing for writing the electrostatic latent image to the photosensitive drum 20.

In FIG. 1, reference numeral 13 indicates a platen cover. Reference numeral 26 indicates an image processing portion that supplies the image data, sent from the image input portion 1 to the image forming portion 2, to the laser beam scanner 22 after processing according to the content of copy work. Reference numeral 54 indicates a manual sheet tray used to manually supply recording sheets P. Reference numeral 55 indicates a sheet transport belt for transporting a recording sheet P to the fixer 4 after a toner image has been secondarily transferred to the recording sheet P. Reference numeral 56 is an inverter pathway for, when performing duplex copying of a recording sheet P, reversing that recording sheet P and transporting it from the fixer 4 to the secondary transfer position.

In the color copy machine of this example configured as described above, the laser beam scanner 22 exposes the photosensitive drum 20 to light based on the image information of the original taken in by the image input portion 1, and thus first an electrostatic latent image corresponding to black is written onto the photosensitive drum 20. On the other hand, in the rotary development unit 23 a black toner developer is disposed at a position facing the photosensitive drum 20, and the electrostatic latent image is developed by the black developer slightly later than the -timing for writing the electrostatic latent image. The black toner image formed in this manner is primarily transferred onto the transfer belt 3 by the primary transfer roller 30, and the transfer belt 3 rotates while supporting the toner image. When the development process by the black developer finishes, exchange of the developer is performed by the time when the transfer belt 3 finishes one rotation cycle, and the yellow toner developer is set at the position facing the photosensitive drum 20 by 90° rotation of the rotary development unit 23. Subsequently these operations are repeated for every rotation cycle of the transfer belt 3, and each time yellow, magenta, and cyan toner images are transferred from the photosensitive drum 20 to the transfer belt 3, forming a layered toner image from the four colors of toner images on the transfer belt 3. The full-color multiple-transferred toner image formed in this manner is secondarily transferred at a predetermined timing to the recording sheet P fed from the registration roller 53, and the recording sheet P to which an unfixed toner image has been transferred is discharged to the discharge sheet tray 50 via the fixer 4.

Figure 2:
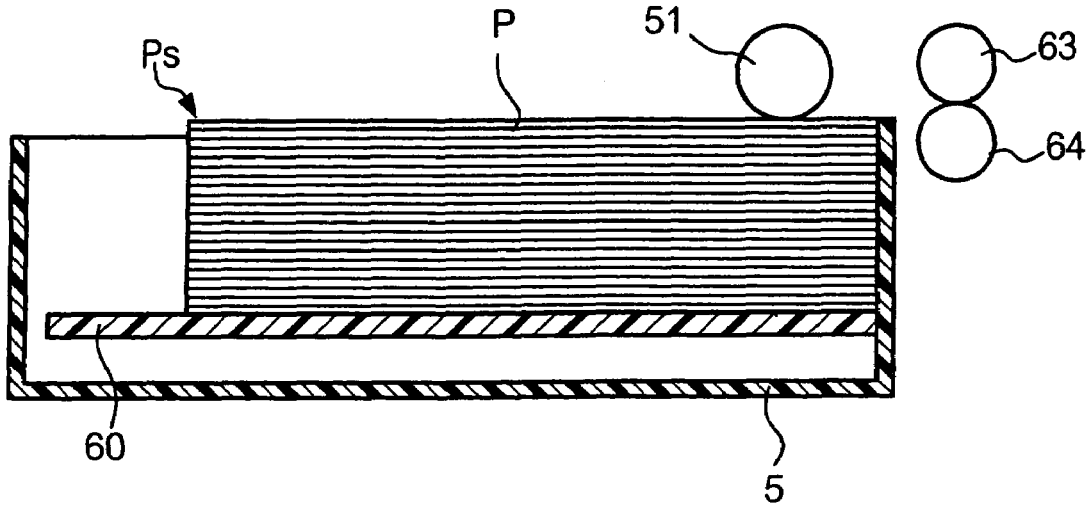
FIG. 2 shows the configuration of a sheet tray according to the exemplary embodiments.

Next, FIG. 2 shows the specific configuration of the sheet tray 5 (the sheet trays 5*a* to 5*d*). The sheet tray 5 is formed in an approximately rectangular shape provided with a storage space P for recording sheets P, and is configured such that it can be inserted into a copy machine housing constituting a sheet supply portion from the front side (near side of the paper face in FIG. 1). A bottom plate 60 that supports recording sheets P, and pushes recording sheets P upward, is provided inside the sheet tray 5. In the copy machine housing into which the sheet tray 5 is inserted, the aforementioned pickup roller 51 is provided corresponding to the front end of the recording sheets P positioned inside the sheet tray 5, and when the recording sheets P are lifted up by elevation of the bottom plate 60, the front end of the recording sheet P positioned uppermost in the sheet tray 5 presses against the pickup roller 51. Thus, when the pickup roller 51 rotates, a predetermined frictional force acts between the recording sheet P and the pickup roller 51, so that the uppermost recording sheet P is drawn out from the sheet tray 5. On the other hand, in order to prevent so-called multi-feeding in which the recording sheet P drawn out from the sheet tray 5 is transported in a state stacked with multiple sheets, a transport roller 63 and a separation roller 64 are provided adjacent to the pickup roller 51 in the copy machine housing.

Figure 3:
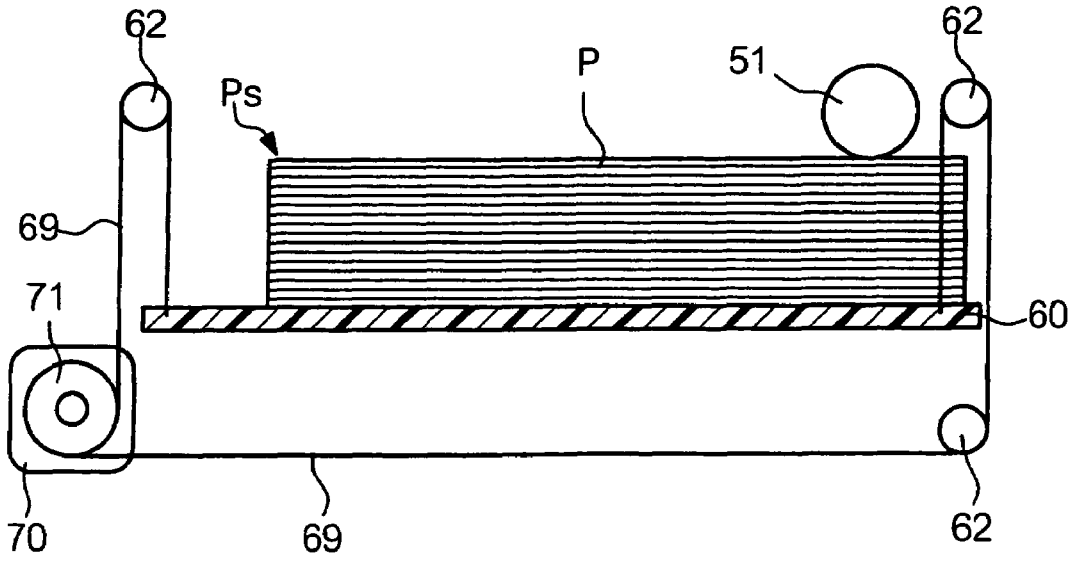
FIG. 3 shows a bottom plate raising/lowering mechanism according to the exemplary embodiments.

Next, FIG. 3 shows a mechanism for raising/lowering the bottom plate 60. A wire 69 strung around a pulley 62 is linked to the bottom plate 60, and when this wire 69 is wound by a winding pulley 71 linked to a lift-up motor 70, the bottom plate 60 elevates inside the sheet tray 5, and thus the uppermost recording sheet P makes contact with the pickup roller 51. The winding pulley 71 is configured such that it is linked to the lift-up motor 70 when the sheet tray 5 is pushed into the copy machine housing, and separated from the lift-up motor 70 when the sheet tray 5 is pulled out of the copy machine housing. Thus, when the sheet tray 5 is pulled out of the apparatus housing, the bottom plate 60 is lowered by its own weight to the bottom face of the sheet tray 5, so that a user can easily refill the sheet tray 5 with recording sheets P. When an unshown sensor confirms that the sheet tray 5 has been completely inserted into the copy machine housing, as a preparatory operation for supplying recording sheets P, the wire 69 is wound by driving the lift-up motor 70, and the bottom plate 60 is raised until the uppermost recording sheet P of the sheet bundle loaded on the bottom plate 60 makes contact with the pickup roller 51.

Further, the pickup roller 51 disposed so as to be vertically movable, and as the number of recording sheets P loaded on the bottom plate 60 decreases due to supplying sheets, the pickup roller 51 steadily drops. Because the pickup roller 51 is maintained at approximately the same height level as the transport roller 63, when the pickup roller 51 drops to a predetermined height level due to continuous sheet supply, this is sensed by an unshown sensor, and using the change in the output signal of this sensor as a trigger, the lift-up motor 70 is driven for a predetermined time. Thus, the bottom plate 60 rises an amount corresponding to the thickness of the recording sheets P that have been supplied, so that the uppermost recording sheet P in the sheet tray 5 always makes contact with the pickup roller 51 at a predetermined height.

Figure 4:
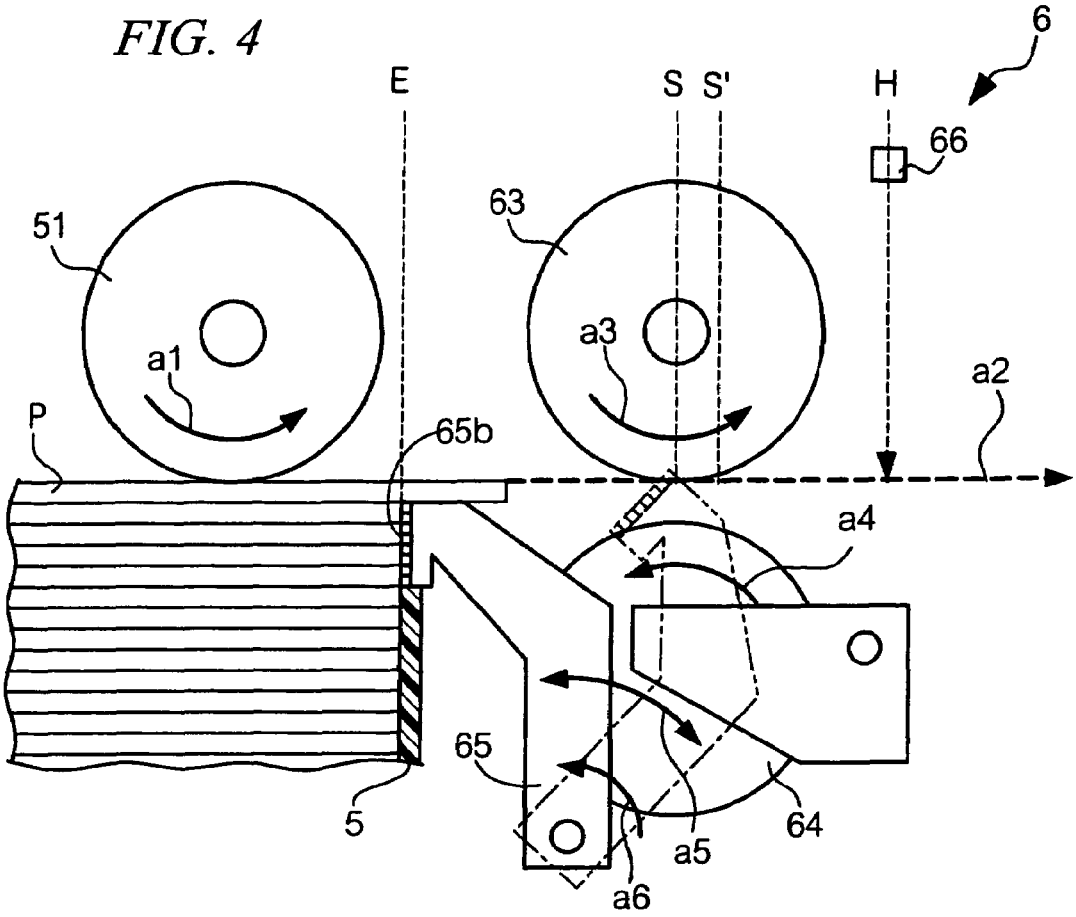
FIG. 4 is a side view of the sheet feeding apparatus according to the exemplary embodiments.
Figure 5:
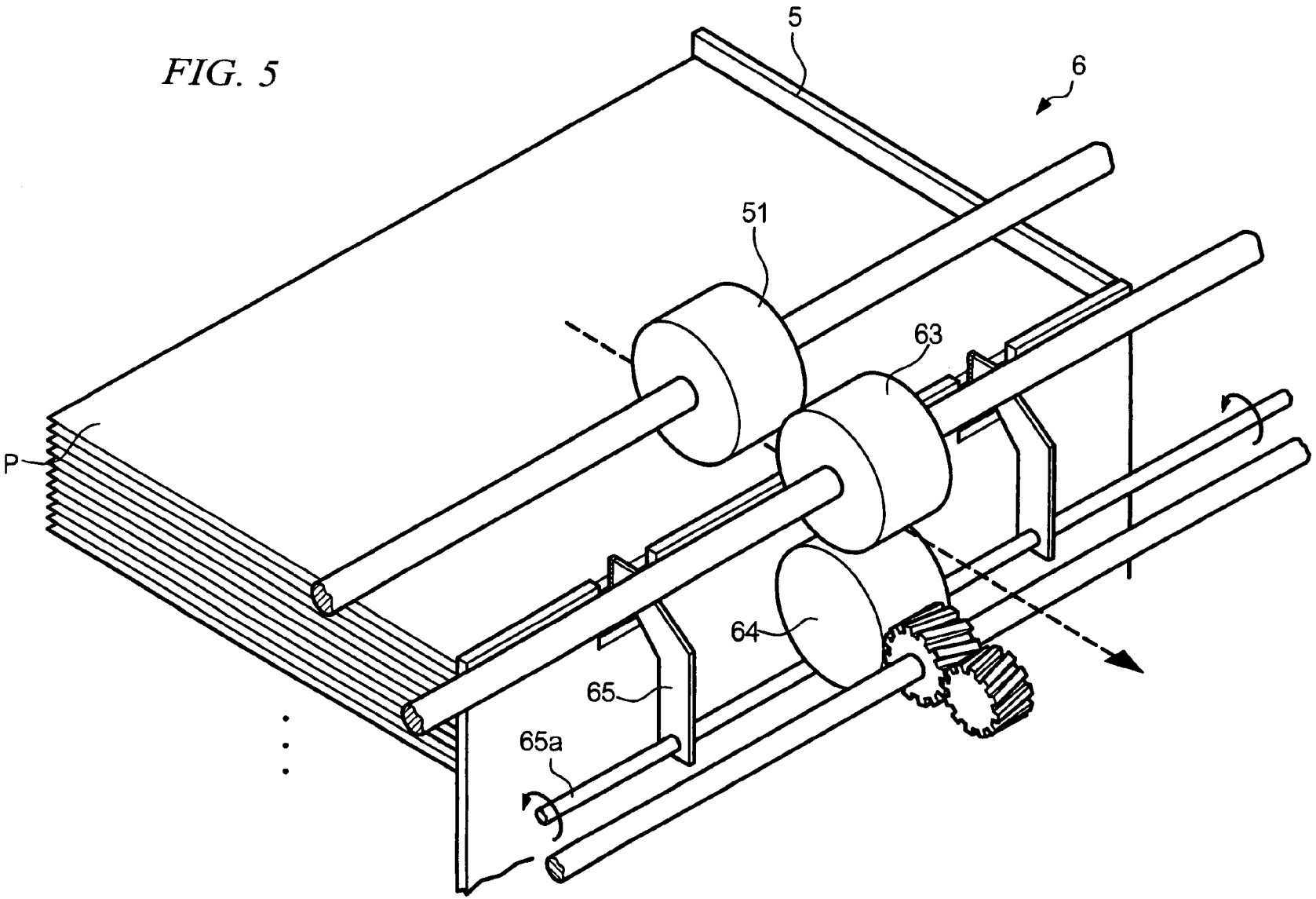
FIG. 5 is an overhead view of the sheet feeding apparatus according to the exemplary embodiments.

Next, FIG. 4 is a side view of a sheet feeding apparatus 6 that draws recording sheets P out of the sheet tray 5 and separates them one by one, and FIG. 5 is an overhead view of the sheet feeding apparatus 6 viewed diagonally from above. In addition to the aforementioned pickup roller 51, transport roller 63, and separation roller 64, the sheet feeding apparatus 6 is provided with a push-back member 65 and a sheet detection sensor 66.

The pickup roller 51 is connected to a raising/lowering mechanism driven by an unshown motor, and is vertically movable. In a state in which the pickup roller 51 is disposed downward by the raising/lowering mechanism, the pickup roller 51 pushes the recording sheets P downward with a predetermined load due to the torque of the motor. As a result, when the pickup roller 51 rotates in the direction of arrow al, recording sheets P sandwiched between the bottom plate 60 and the pickup roller 51 are transported in the direction of arrow a2, in order beginning with the uppermost recording sheet P. The state in which the pickup roller 51 presses against the recording sheets P is referred to below as an "ON state". On the other hand, a state in which the pickup roller 51 is moved upward by the raising/lowering mechanism, removing its load from the recording sheets P, is referred to as an "OFF state". In the "OFF state", a recording sheet P is not transported by rotation of the pickup roller 51.

The transport roller 63 is driven by an unshown motor while pressed against with a predetermined pressure upward from the separation roller 64, and thus rotates in the direction of arrow a3. As a result, a recording sheet P that has reached a separation action point S, which is the position where the transport roller 63 and the separation roller 64 make contact, is further transported in the direction of arrow a2 by force received from the transport roller 63.

The separation roller 64 receives a predetermined force upward from an unshown elastic member, and at the separation action point S presses against the transport roller 63 directly or via a recording sheet P. As a reaction, the separation roller 64 is pressed against with a predetermined pressure from the transport roller 63. The separation roller 64 is driven by an unshown motor and thus rotates in the direction of arrow a4.

The transport roller 63 and the separation roller 64 rotate in the same direction while making contact with each other at the separation action point S. Thus, a recording sheet P that attempts to pass between the transport roller 63 and the separation roller 64, at the same time that it receives force in the direction of arrow a2 from the transport roller 63, receives force in the direction opposite to the arrow a2 from the separation roller 64. When one recording sheet P not accompanied by a fed-together recording sheet P has reached the separation action point S, the force applied to the recording sheet P at the separation action point S by the transport roller 63 is adjusted so as to be larger than the force applied to the recording sheet P at the separation action point S by the separation roller 64. As a result, the entire recording sheet P receives force in the direction of arrow a2, and is further transported in the direction of arrow a2 after passing the separation action point S.

On the other hand, when two or more fed-together recording sheets P in a stacked state have reached the separation action point S, the entire uppermost recording sheet P (hereinafter, in order from uppermost, referred to as "first recording sheet P", "second recording sheet P", . . . etc.) receives force in the direction of the arrow a2 and is thus further transported in the direction of arrow a2 after passing the separation action point S, and moreover, the entire second or subsequent recording sheet P receives force in the direction opposite to the arrow a2, and is stopped with its downstream end positioned at the separation action point S. This is described below with reference to the figures.

Figure 6:
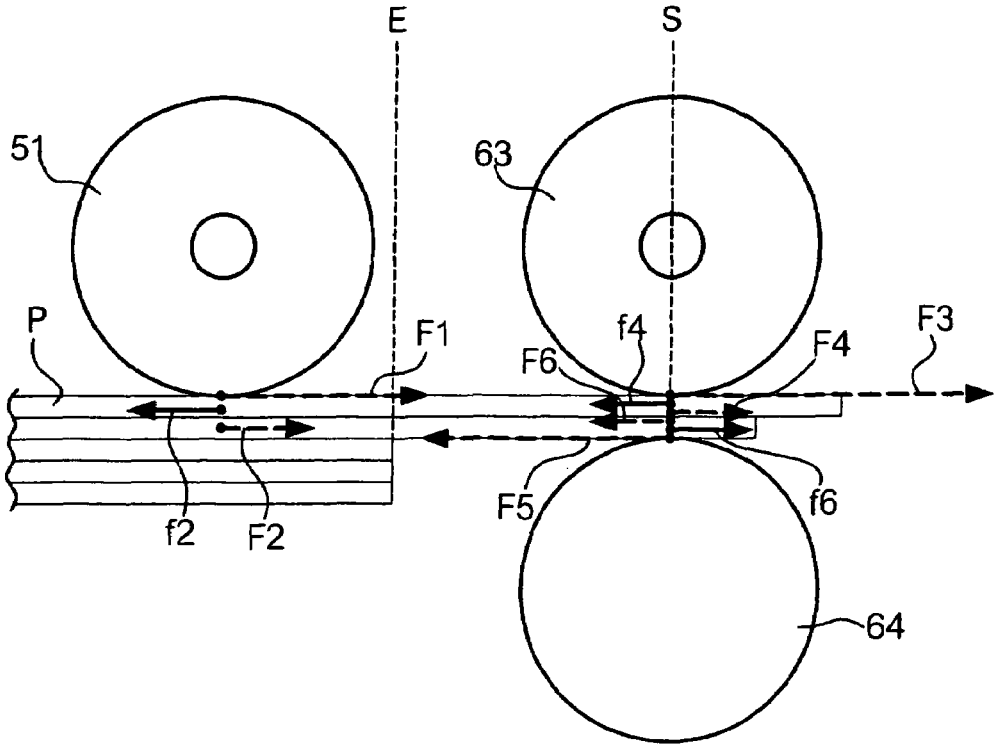
FIG. 6 shows the relationship of forces applied to a recording sheet in the sheet feeding apparatus according to the exemplary embodiments.

FIG. 6 shows the relationship of forces applied to recording sheets P by the pickup roller 51, the transport roller 63, and the separation roller 64 in a state in which, with the pickup roller 51 in the ON state, two or more fed-together recording sheets P in a stacked state have reached the separation action point S, and the downstream end of the first and second recording sheets P have for some reason passed the separation action point S. However, in the following description, it is assumed that between the first and second recording sheets P, frictional force is only produced at the points pressed against vertically from the pickup roller 51, the transport roller 63, and the separation roller 64. Frictional force produced at other contact points is minute by comparison, and is therefore ignored. The arrows in FIG. 6 respectively indicate the following forces.

F1: force applied to the first recording sheet P by the pickup roller 51

F2: force applied to the second recording sheet P by the pickup roller 51 via frictional force f2: force received by the first recording sheet P from the second recording sheet P as a reaction to F2

F3: force applied to the first recording sheet P by the transport roller 63

F4: force applied to the second recording sheet P by the transport roller 63 via frictional force f4: force received by the first recording sheet P from the second recording sheet P as a reaction to F4

F5: force applied to the second recording sheet P by the separation roller 64

F6: force applied to the first recording sheet P by the separation roller 64 via frictional force f6: force received by the second recording sheet P from the first recording sheet P as a reaction to F6

When the rigidity of the recording sheets P in the transport direction is sufficiently large in comparison to the forces stated above, the respective recording sheets P do not bend and are transported by the resultant force of the force they receive. Specifically, the first recording sheet P receives force (F1+F3) in the rightward direction in FIG. 6, and receives force (f2+f4+F6) in the leftward direction in FIG. 6. The second recording sheet P receives force (F2+F4+f6) in the rightward direction in FIG. 6, and receives force (F5) in the leftward direction in FIG. 6. In the sheet feeding apparatus 6, the driving force or the like applied to the pickup roller 51, the transport roller 63, and the separation roller 64 is adjusted so as to satisfy Formulas 1 and 2 below.

$$(F1+F3)>(f2+f4+F6) \quad \text{(Formula 1)}$$

$$(F2+F4+f6)<(F5) \quad \text{(Formula 2)}$$

The force applied from the pickup roller 51, the transport roller 63, and the separation roller 64 via the frictional force with other recording sheets P is very small in comparison to the force applied directly by those rollers. Accordingly, it is not difficult to adjust the torque of the pickup roller 51, the transport roller 63, and the separation roller 64 so as to satisfy above Formulas 1 and 2.

From the relationship in Formula 1, the first recording sheet P receives force as a whole in the rightward direction in FIG. 6, and is transported in the rightward direction without stopping. From the relationship in Formula 2, the second recording sheet P receives force as a whole in the leftward direction in FIG. 6, and is thus oppositely transported in the leftward direction until its downstream end reaches the separation action point S.

Figure 7:
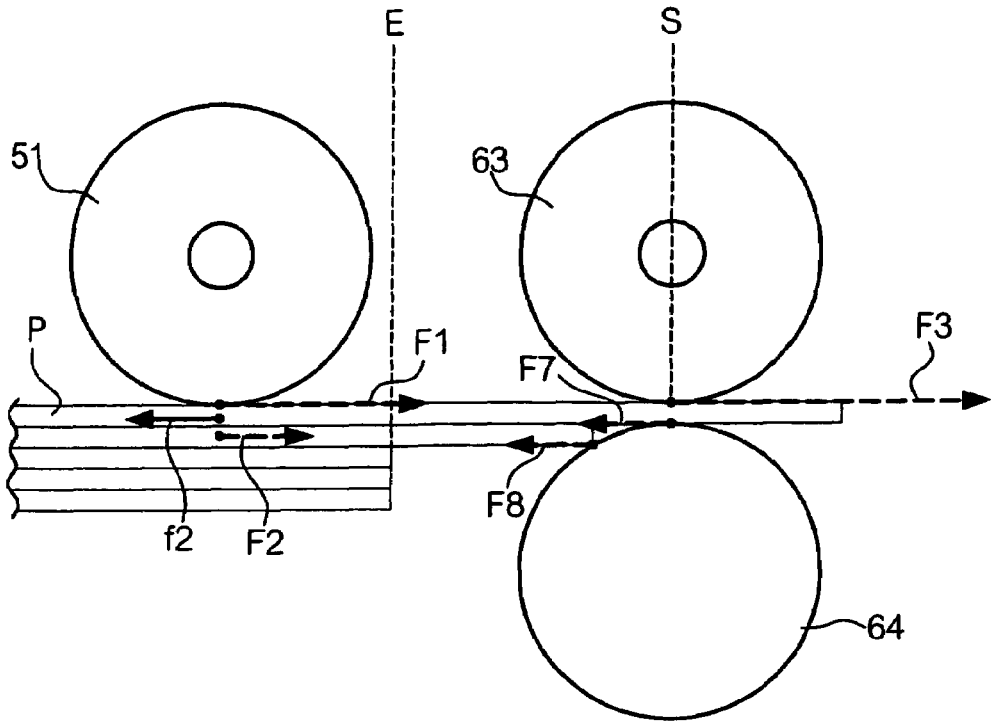
FIG. 7 shows the relationship of forces applied to a recording sheet in the sheet feeding apparatus according to the exemplary embodiments.

FIG. 7 shows the relationship of forces applied to recording sheets P by the pickup roller 51, the transport roller 63, and the separation roller 64 in a state in which, with the pickup roller 51 in the ON state, two or more fed-together recording sheets P in a stacked state have reached the separation action point S, and the downstream end of the first and second recording sheets P have for some reason passed the separation action point S, after the downstream end of the second recording sheet P has been transported in reverse until reaching the separation action point S. The arrows in FIG. 7 respectively indicate the following forces.

F1: force applied to the first recording sheet P by the pickup roller 51

F2: force applied to the second recording sheet P by the pickup roller 51 via frictional force f2: force received by the first recording sheet P from the second recording sheet P as a reaction to F2

F3: force applied to the first recording sheet P by the transport roller 63

F7: force applied to the first recording sheet P by the separation roller 64

F8: force applied to the second recording sheet P by the separation roller 64

In the sheet feeding apparatus 6, the driving force or the like applied by the pickup roller 51, the transport roller 63, and the separation roller 64 is adjusted so as to satisfy Formula 3 below, in addition to above Formulas 1 and 2. In this case as well, such adjustment is not difficult.

$$(F1+F3)>(f2+F7) \quad \text{(Formula 3)}$$

In a state in which the downstream end of the second recording sheet P is positioned at the separation action point S, the second recording sheet P is in a state in which it is not held sandwiched by the transport roller 63 and the separation roller 64, and in which the end is slidingly pressed against from the side by the separation roller 64. Accordingly, Formula 4 below is usually satisfied.

$$(F2)=(F8) \quad \text{(Formula 4)}$$

From the relationship in Formula 3, the first recording sheet P receives force as a whole in the rightward direction in FIG. 6, and is transported in the rightward direction without stopping. From the relationship in Formula 4, the second recording sheet P, without receiving force as a whole in either the rightward or leftward directions, is stopped with its downstream end having reached the separation action point S.

Figure 8:
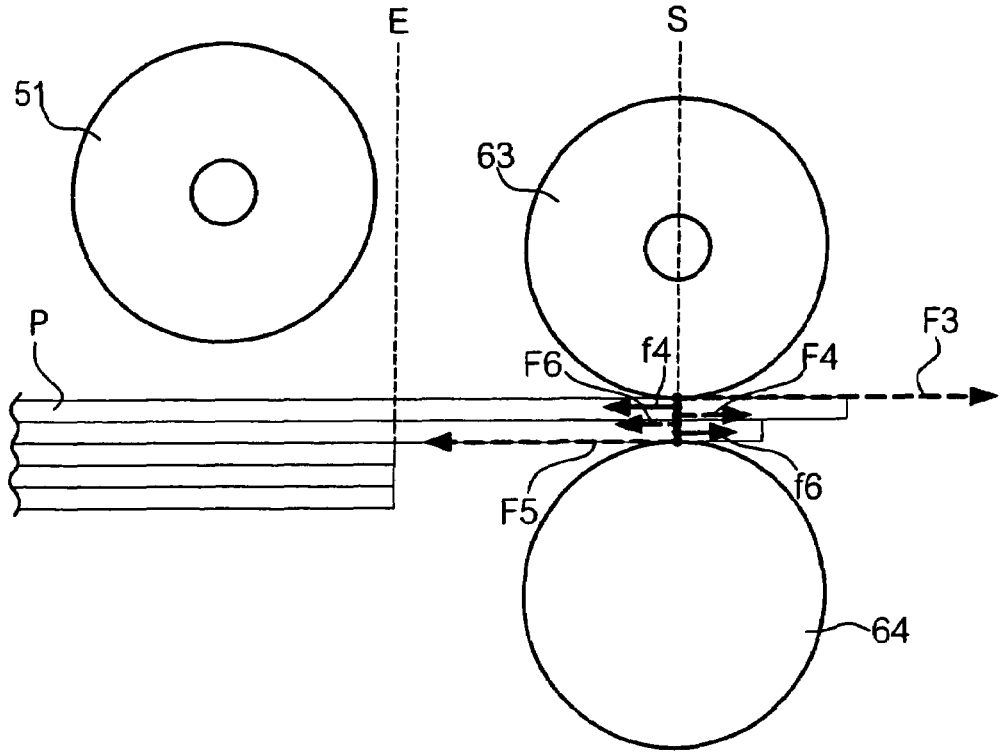
FIG. 8 shows the relationship of forces applied to a recording sheet in the sheet feeding apparatus according to the exemplary embodiments.

FIG. 8 shows the relationship of forces applied to recording sheets P by the pickup roller 51, the transport roller 63, and the separation roller 64 in a state in which, with the pickup roller 51 in the OFF state, the downstream end of the first and second recording sheets P have for some reason passed the separation action point S. The arrows in FIG. 8 respectively indicate the following forces.

F3: force applied to the first recording sheet P by the transport roller 63

F4: force applied to the second recording sheet P by the transport roller 63 via frictional force f4: force received by the first recording sheet P from the second recording sheet P as a reaction to F4

F5: force applied to the second recording sheet P by the separation roller 64

F6: force applied to the first recording sheet P by the separation roller 64 via frictional force f6: force received by the second recording sheet P from the first recording sheet P as a reaction to F6

In the sheet feeding apparatus 6, the driving force or the like applied by the transport roller 63 and the separation roller 64 is further adjusted so as to satisfy Formulas 5 and 6 below. In this case as well, such adjustment is not difficult.

$$(F3)>(f4+F6) \quad \text{(Formula 5)}$$

$$(F4+f6)<(F5) \quad \text{(Formula 6)}$$

Figure 9:
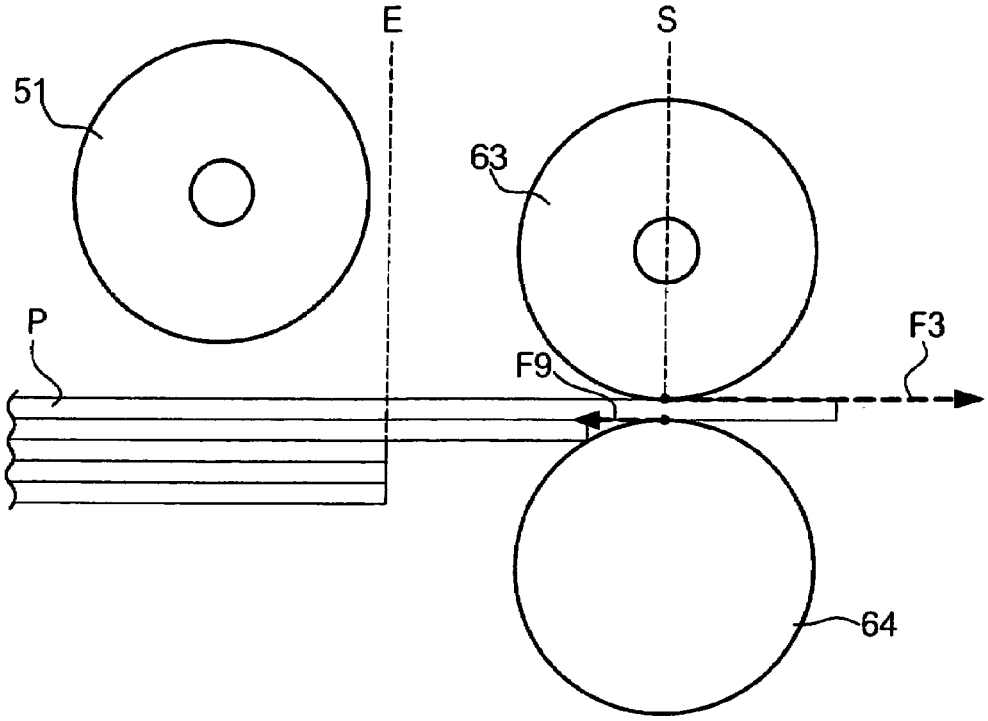
FIG. 9 shows the relationship of forces applied to a recording sheet in the sheet feeding apparatus according to the exemplary embodiments.

FIG. 9 shows the relationship of forces applied to recording sheets P by the pickup roller 51, the transport roller 63, and the separation roller 64 in a state in which, with the pickup roller 51 in the OFF state, two or more fed-together recording sheets P in a stacked state have reached the separation action point S, and the downstream end of the first and second recording sheets P have for some reason passed the separation action point S, after the downstream end of the second recording sheet P has been transported in reverse until reaching the separation action point S. The arrows in FIG. 9 respectively indicate the following forces.

F3: force applied to the first recording sheet P by the transport roller 63

F9: force applied to the first recording sheet P by the separation roller 64

In the sheet feeding apparatus 6, the driving force or the like applied by the transport roller 63 and the separation roller 64 is further adjusted so as to satisfy Formula 7 below. In this case as well, such adjustment is not difficult.

$$(F3)>(F9) \quad \text{(Formula 7)}$$

In a state in which the downstream end of the second recording sheet P is positioned at the separation action point S, the second recording sheet P receives force in the rightward direction due to the frictional force between the first recording sheet P and the second recording sheet P, and receives force of the same magnitude in the leftward direction from the side of the end from the separation roll 64. These are minute forces and therefore are not shown in FIG. 9, and are in equilibrium.

As described above, as a result of satisfying Formulas 5 to 7, even when the pickup roller 51 is in the OFF state, same as when the pickup roller 51 is in the ON state, the first recording sheet P is transported in the rightward direction, and the second recording sheet P is stopped with its downstream end having reached the separation action point S. Above an instance was described in which two fed-together recording sheets P were transported in a stacked state. An instance in which three or more recording sheets P are transported in a stacked state can be considered the same, and so a description thereof is omitted.

Returning to FIG. 4, the configuration of the sheet feeding apparatus 6 will be further described. The push-back member 65 pivots around a pivot shaft 65*a* in the range indicated by arrow a5. With pivoting of the push-back member 65, an end 65*b* of the push-back member 65 moves back and forth between a separation action point S' positioned slightly downstream from the separation action point S, and an end point E that is an end point downstream in the transport direction of the recording sheets P in the sheet tray 5. The position and shape of the end 65*b* of the push-back member 65 is adjusted such that when the end 65*b* reaches the separation action point S' it releases the recording sheet P. The push-back member 65 receives torque in the direction of arrow a6 from an unshown elastic body or motor.

A sheet detection sensor 66, for example, uses an optical sensor to detect that the downstream end of a recording sheet P has reached a detection point H. The sheet detection sensor 66 is connected to an unshown control portion, and sends a detection signal to the control portion when the downstream end of a recording sheet P reaches the detection point H. The control portion controls a motor (not shown) that drives the pickup roller 51, a motor (not shown) that drives the raising/lowering mechanism (not shown) that raises/lowers the pickup roller 51, a motor (not shown) that drives the transport roller 63, and a motor (not shown) that drives the separation roller 64, and controls the driving force of these motors. Also, in an example in which the push-back member 65 is driven by a motor and thus rotates, the control portion also controls the driving force of that motor.

As described above, the sheet feeding apparatus 6, while primarily continuing transport of the first recording sheet P due to operation of the separation roller 64, stops a fed-together second or subsequent recording sheet P with its downstream end positioned at the separation action point S. In addition to this characteristic, the sheet feeding apparatus 6 also has the characteristic that, while continuing transport of the first recording sheet P, a fed-together second or subsequent recording sheet P is transported in reverse by the push-back member 65 until the downstream end reaches the downstream end point of the sheet tray 5. Various operation of the push-back member 65 is conceivable according to the magnitude and control of the torque applied to the push-back member 65. Below, specific examples of these are disclosed as examples of the invention.

EXAMPLE 1

In Example 1, the push-back member 65 receives torque in the direction of arrow a6 in FIG. 4 from the tensile force of an elastic body such as a spring or rubber. This torque, according to the spring constant of the elastic body, grows smaller as the end 65*b* of the push-back member 65 approaches the end point E, and grows larger as the end 65*b* of the push-back member 65 approaches the separation action point S.

Figure 10:
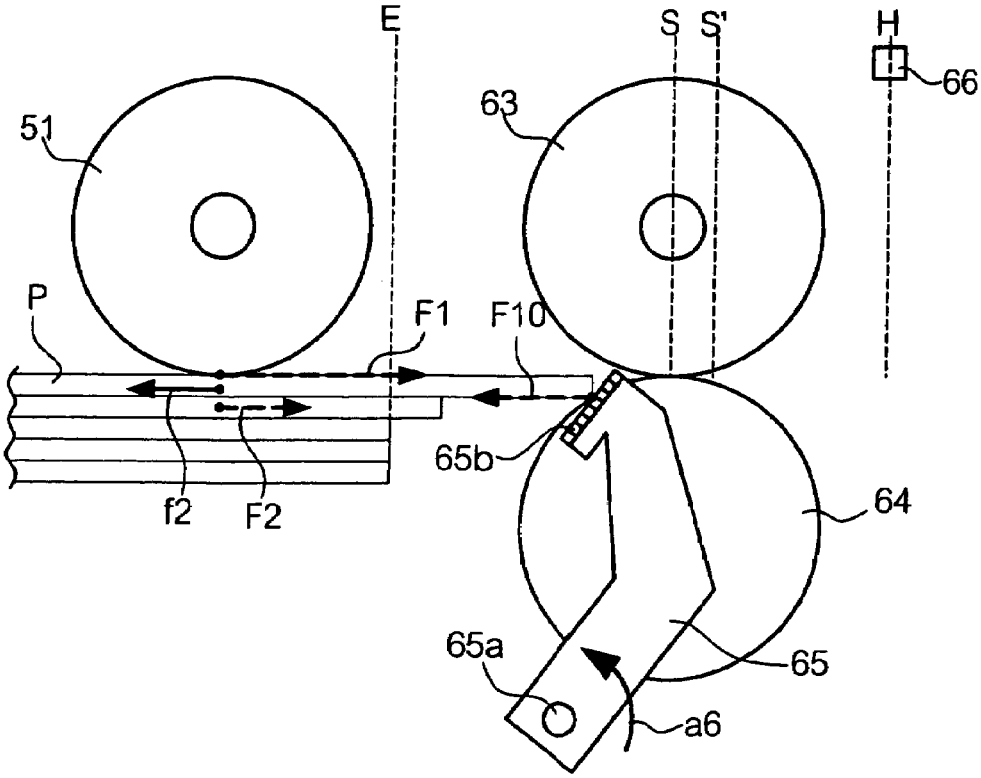
FIG. 10 shows the relationship of forces applied to a recording sheet in the sheet feeding apparatus according to the exemplary embodiments.

FIG. 10 shows the relationship of forces applied to the first and second recording sheets P in a state in which transport from the sheet tray 5 to the outside by the pickup roller 51 has begun, with two recording sheets P stacked. The arrows in FIG. 10 respectively indicate the following forces.

F1: force applied to the first recording sheet P by the pickup roller 51

F2: force applied to the second recording sheet P by the pickup roller 51 via frictional force f2: force received by the first recording sheet P from the second recording sheet P as a reaction to F2

F10: force applied to the first recording sheet P by the push-back member 65

The end 65*b* of the push-back member 65 is positioned at the end point E before transport of a recording sheet P, but is pushed by the first recording sheet P and moves in the direction opposite to arrow a6. This is accompanied by a steady increase in F10. Taking F10max' as F10 in the state with the end 65*b* of the push-back member 65 having reached the separation action point S', the length, spring constant, and the like of the elastic body are adjusted so as to satisfy Formula 8 below.

$$(F1)>(f2+F10\text{max}') \quad \text{(Formula 8)}$$

From the relationship in Formula 8, the first recording sheet P is released from the push-back member 65 after the downstream end of the first recording sheet P reaches the separation action point S', and is further transported in the rightward direction in FIG. 10.

Figure 11:
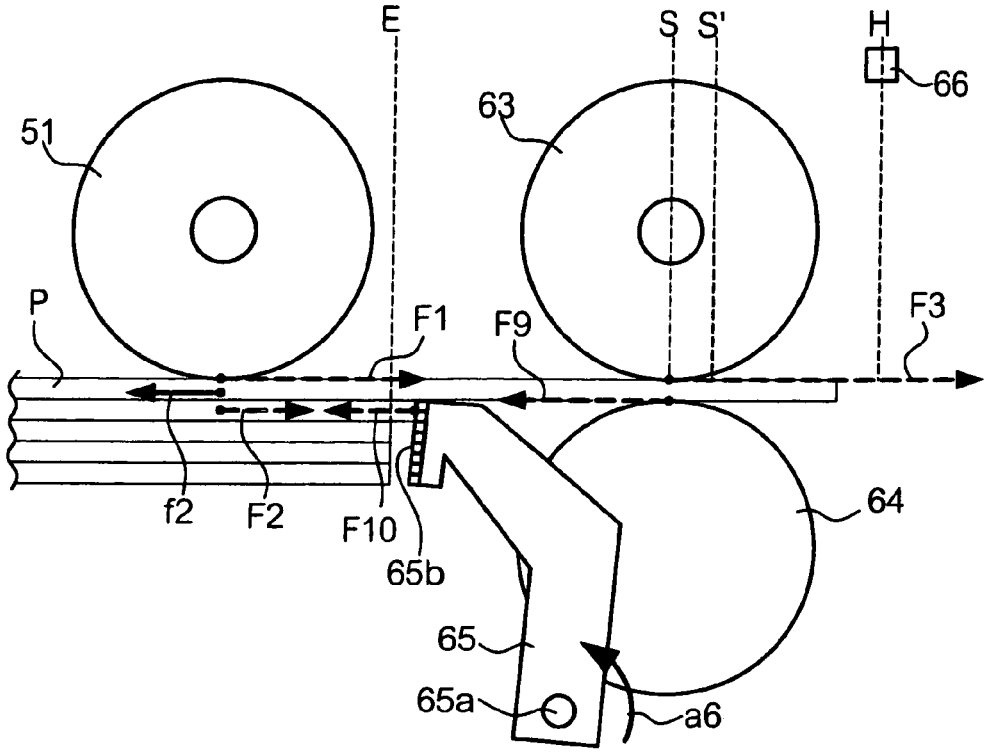
FIG. 11 shows the relationship of forces applied to a recording sheet in the sheet feeding apparatus according to the exemplary embodiments.

FIG. 11 shows the relationship of forces applied to the first and second recording sheets P in a state immediately after the first recording sheet P has been released from the push-back member 65. The arrows in FIG. 11 respectively indicate the following forces.

F1: force applied to the first recording sheet P by the pickup roller 51

F2: force applied to the second recording sheet P by the pickup roller 51 via frictional force f2: force received by the first recording sheet P from the second recording sheet P as a reaction to F2

F3: force applied to the first recording sheet P by the transport roller 63

F9: force applied to the first recording sheet P by the separation roller 64

F10: force applied to the first recording sheet P by the push-back member 65

In the state shown in FIG. 11, the first recording sheet P is in contact with the end 65*b* of the push-back member 65 at its bottom face, and is receiving force in the leftward direction, but the magnitude of that force is small enough that it can be ignored, and so a description thereof is omitted.

In the state in FIG. 11, the length, spring constant, and the like of the elastic body are adjusted so as to satisfy Formulas 9 and 10 below, where F10max indicates F10 when the end 65*b* of the push-back member 65 is positioned at the separation action point S.

$$(F1+F3)>(f2+F9) \quad \text{(Formula 9)}$$

$$(F2)<(F10\text{max}) \quad \text{(Formula 10)}$$

From the relationship in Formula 9, the first recording sheet P is continuously transported in the rightward direction in FIG. 11. On the other hand, from the relationship in Formula 10, the second recording sheet P is transported in reverse by the push-back member 65 to a position where (F2)=(F10), that is, any position between the end point E and the separation action point S, and then stops in that position.

From the state in FIG. 11, the first recording sheet P is transported in the rightward direction, and when its downstream end reaches the detection point H, the sheet detection sensor 66 sends a detection signal to the control portion. When the control portion receives a detection signal, it moves the pickup roller 51 upward by controlling the motor (not shown) that drives the raising/lowering mechanism (not shown) that raises/lowers the pickup roller 51, placing the pickup roller 51 in the OFF state.

Figure 12:
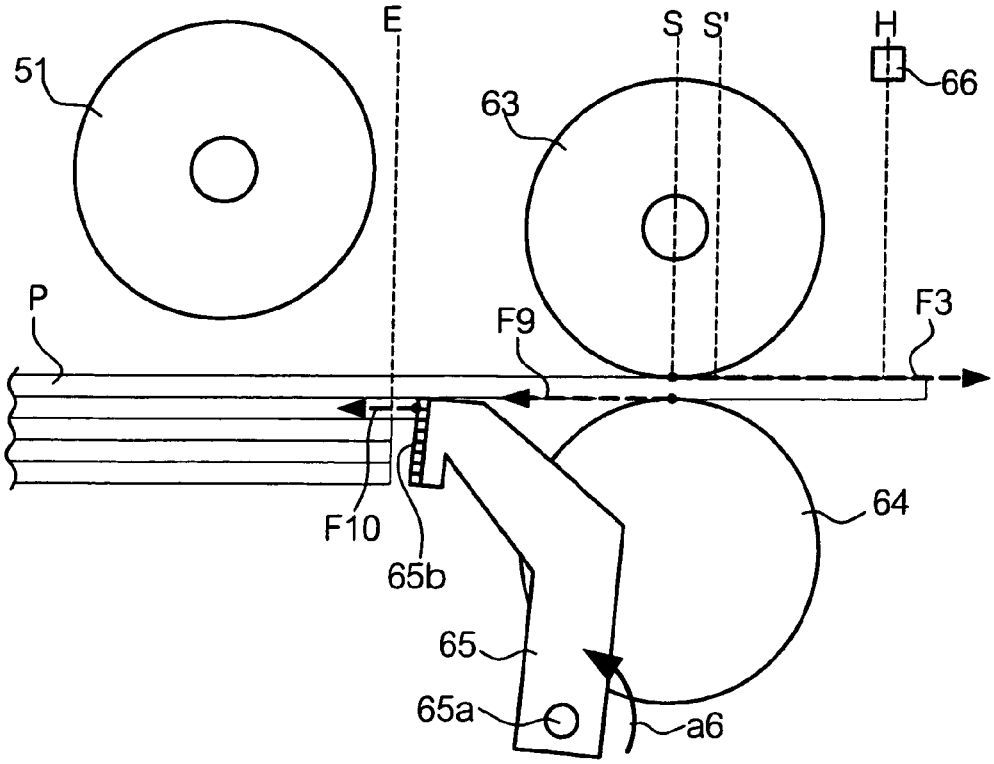
FIG. 12 shows the relationship of forces applied to a recording sheet in the sheet feeding apparatus according to the exemplary embodiments.

FIG. 12 shows the relationship of forces applied to the first and second recording sheets P in a state immediately after the pickup roller 51 has entered the OFF state. The arrows in FIG. 12 respectively indicate the following forces.

F3: force applied to the first recording sheet P by the transport roller 63

F9: force applied to the first recording sheet P by the separation roller 64

F10: force applied to the first recording sheet P by the push-back member 65

Here, because (F3)>(F7), the first recording sheet P is continuously transported rightward. On the other hand, because the second recording sheet P only receives F10 in the leftward direction, the second recording sheet P is transported in reverse in the leftward direction until its downstream end reaches the end point E.

When the pickup roller 51 is in the ON state, even if the downstream end of the second recording sheet P has reached the separation action point S for some reason, that end is kept positioned at the separation action point S by the operation of the separation roller 64. Accordingly, when the pickup roller 51 enters the OFF state, the second recording sheet P is transported in reverse to the sheet tray 5 by the push-back member 65.

As described above, in Example 1, the first recording sheet P is continuously transported in the original direction, and on the other hand, when the pickup roller 51 is in the ON state, a fed-together second or subsequent recording sheet P is stopped with its downstream end between the end point E and the separation action point S, and is transported in reverse to the sheet tray 5 when the pickup roller has entered the OFF state.

Incidentally, in Example 1 described above, torque was applied to the push-back member 65 by an elastic body such as a spring, but modifying this part of the configuration, a fixed torque may be applied by the driving force of a motor. In that case, the control portion controls the driving force of the motor that applies torque to the push-back member 65 such that the relationship of the forces shown in FIGS. 10 and 11 satisfies Formulas 11 and 12 below.

$$(F1)>(f2+F10) \quad \text{(Formula 11)}$$

$$(F2)<(F10) \quad \text{(Formula 12)}$$

In this case as well, the first recording sheet P overcomes F10, which is the push-back force of the push-back member 65, and is transported in the normal direction, and on the other hand, a second or subsequent recording sheet P is pushed back by the push-back force of the push-back member 65 and thus transported in reverse to the sheet tray 5.

Figure 13:
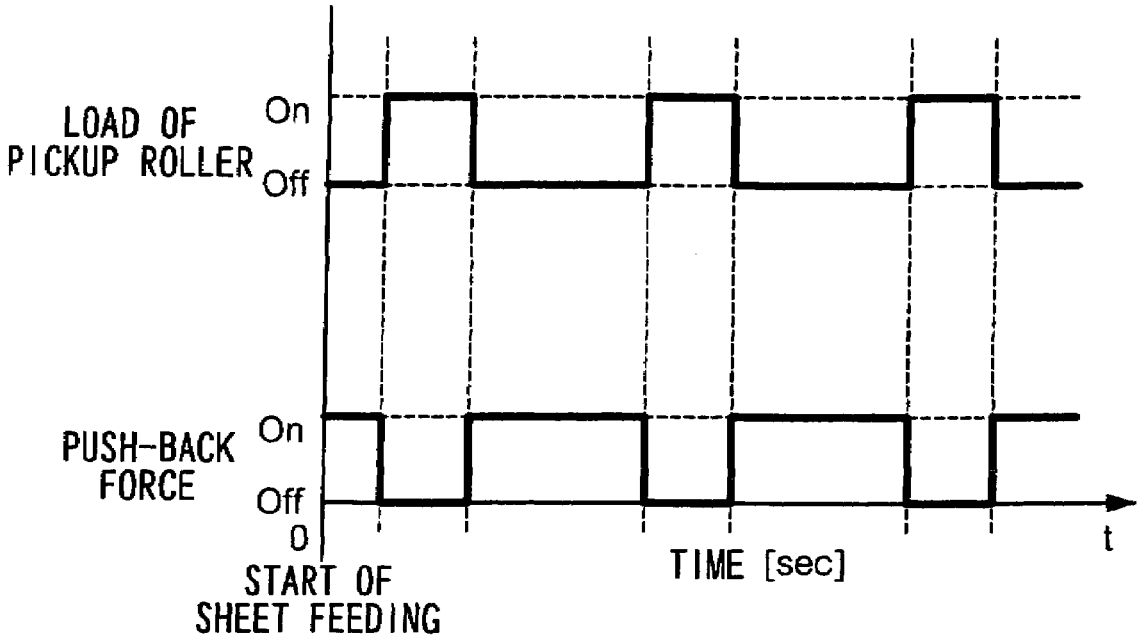
FIG. 13 is a graph that shows changes over time in the magnitude of push-back force of a push-back member and the state of a pickup roller according to the exemplary embodiments.

Moreover, the control portion may control the driving force of the motor that applies torque to the push-back member 65 such that the torque applied to the push-back member 65 during a period when the pickup roller 51 is in the OFF state is greater than the torque applied to the push-back member 65 during a period when the pickup roller 51 is in the ON state. FIG. 13 is a graph that shows, in such a modified example of Example 1, the change over time of the magnitude of the push-back force of the push-back member 65 and the ON state and OFF state of the pickup roller 51. F10 in FIG. 13 satisfies Formulas 11 and 12 above.

When, in this manner, a larger torque is applied to the push-back member 65 during a period in which the pickup roller 51 is in the OFF state, even if, for example, multiple recording sheets P are fed together, and the pickup roller 51 is in the OFF state and it is not possible to push those fed-together recording sheets P back to the sheet tray 5 with the force of F10, it is still possible to push those recording sheets P back to the sheet tray 5.

As shown in FIG. 12, during a period in which the pickup roller 51 is in the OFF state, only a negligible push-back force is applied to the first recording sheet P by the push-back member 65, so even if the torque applied to the push-back member 65 is increased, transport of the first recording sheet P is not impaired.

EXAMPLE 2

Figure 14:
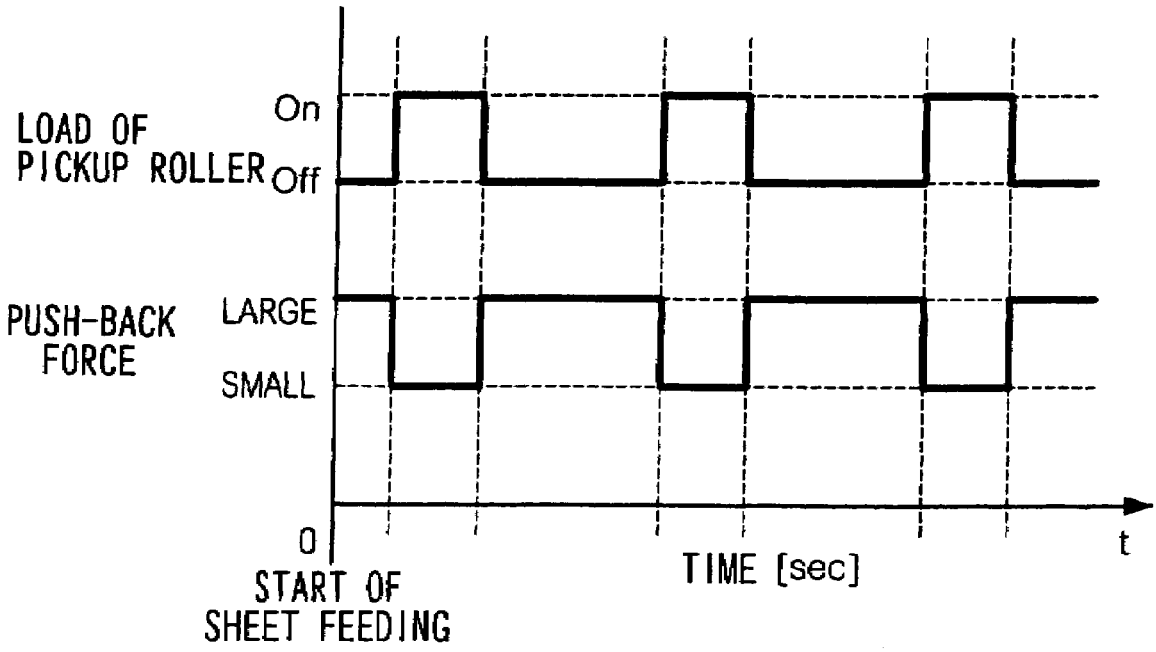
FIG. 14 is a graph that shows changes over time in the magnitude of push-back force of a push-back member and the state of a pickup roller according to the exemplary embodiments.

In Example 2, the push-back member 65 receives torque in the direction of arrow a6 in FIG. 4 from the driving force of a motor, but due to control of the motor by the control portion, only receives torque during a period in which the pickup roller 51 is in the OFF state. FIG. 14 is a graph that shows changes over time in the magnitude of the push-back force of the push-back member 65 and the ON state and OFF state of the pickup roller 51.

In Example 2, immediately before the pickup roller 51 switches from the OFF state to the ON state, the end 65*b* of the push-back member 65 is positioned at the end point E. Afterward, when the pickup roller 51 switches to the ON state, transport of a recording sheet P by the pickup roller 51 begins. Because torque is not applied to the push-back member 65, it is pushed by the downstream end of the recording sheet P, and moves until the end 65*b* reaches the separation action point S'. When the end 65 reaches the separation action point S', the recording sheet P is released from the push-back member 65.

Figure 15:
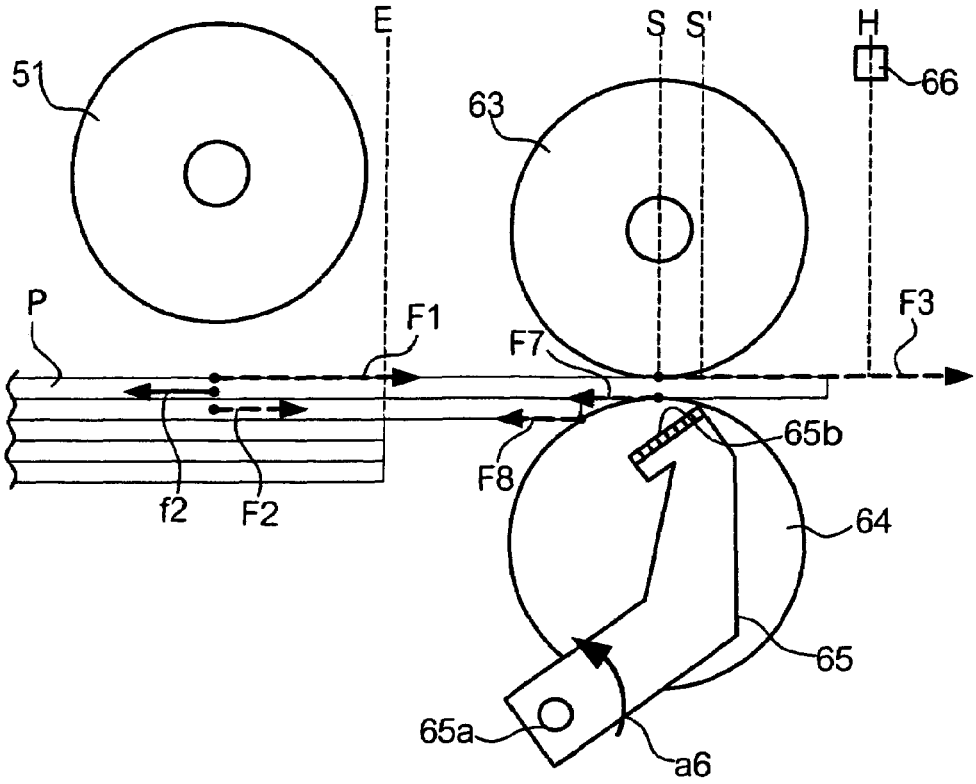
FIG. 15 shows the relationship of forces applied to a recording sheet in the sheet feeding apparatus according to the exemplary embodiments.

FIG. 15 shows, in Example 2, the relationship of forces applied to first and second recording sheets P in a state in which after two recording sheets P are transported stacked and then released from the push-back member 65, the downstream end of the first recording sheet P has not yet reached the detection point H. The forces indicated by the arrows in FIG. 15 and their relationship are the same as shown in FIG. 7, so a description thereof is omitted here.

In the state shown in FIG. 15, as previously described with reference to FIG. 7, due to the operation of the separation roller 64, the first recording sheet P is continuously transported in the rightward direction, but the second recording sheet P is stopped at the position where its end has reached the separation action point S.

Afterward, when the downstream end of the first recording sheet P reaches the detection point H, the control portion controls the motor that drives the raising/lowering mechanism such that the pickup roller 51 moves upward according to the detection signal received from the sheet detection sensor 66, thus placing the pickup roller 51 in the OFF state. At the same time, the control portion controls the motor that drives the push-back member 65, applying a predetermined torque to the push-back member 65.

Figure 16:
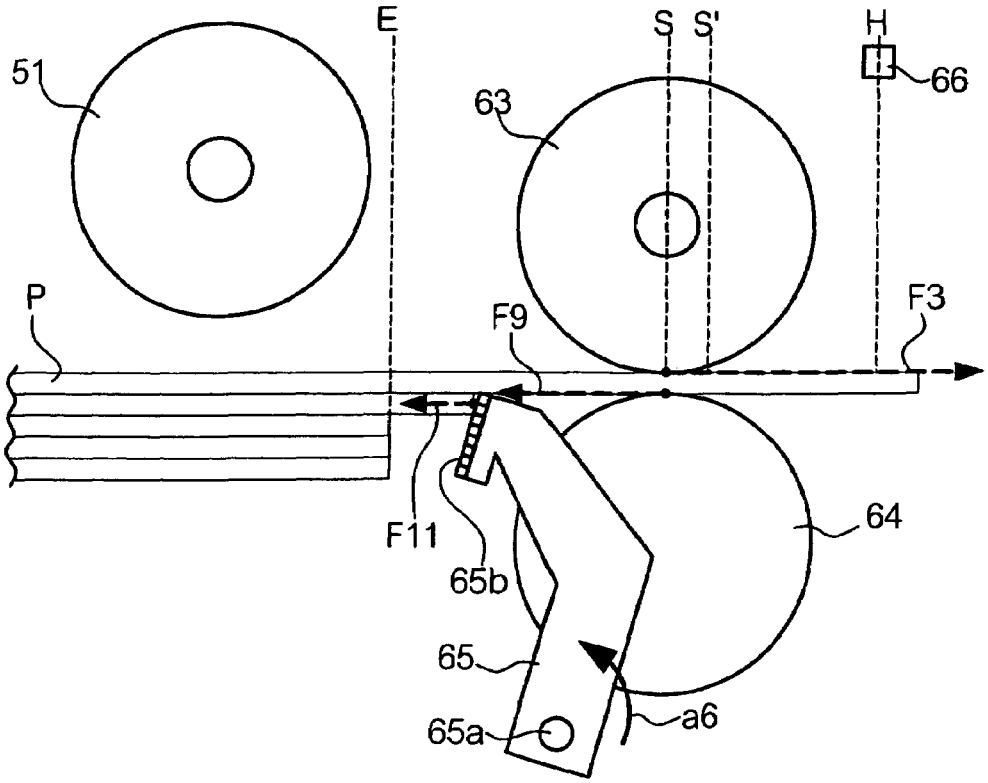
FIG. 16 shows the relationship of forces applied to a recording sheet in the sheet feeding apparatus according to the exemplary embodiments.

FIG. 16 shows the relationship of forces applied to the first and second recording sheets P in a state immediately after the pickup roller 51 has entered the OFF state. The arrows in FIG. 16 respectively indicate the following forces.

F3: force applied to the first recording sheet P by the transport roller 63

F9: force applied to the first recording sheet P by the separation roller 64

F11: force applied to the second recording sheet P by the push-back member 65

Here, because (F3)>(F9), the first recording sheet P is continuously transported rightward. On the other hand, because the second recording sheet P only receives F11 in the leftward direction, the second recording sheet P is transported in reverse in the leftward direction until its downstream end reaches the end point E.

As described above, in Example 2, the first recording sheet P is continuously transported in the original direction, and on the other hand, when the pickup roller 51 is in the ON state, a fed-together second or subsequent recording sheet P is stopped with its downstream end at the position of the separation action point S, and is transported in reverse to the sheet tray 5 when the pickup roller has entered the OFF state.

Incidentally, in Example 2 described above, a motor that drives the raising/lowering mechanism that raises/lowers the pickup roller 51, and a motor that applies torque to the push-back member 65, are separately provided, and are separately controlled by the control portion. Modifying this, a configuration may also be adopted in which a power transmission system is provided that joins raising of the pickup roller 51 and application of torque to the push-back member 65, so that raising of the pickup roller 51 and application of torque to the push-back member 65 are performed with a single motor.

Figure 17A:
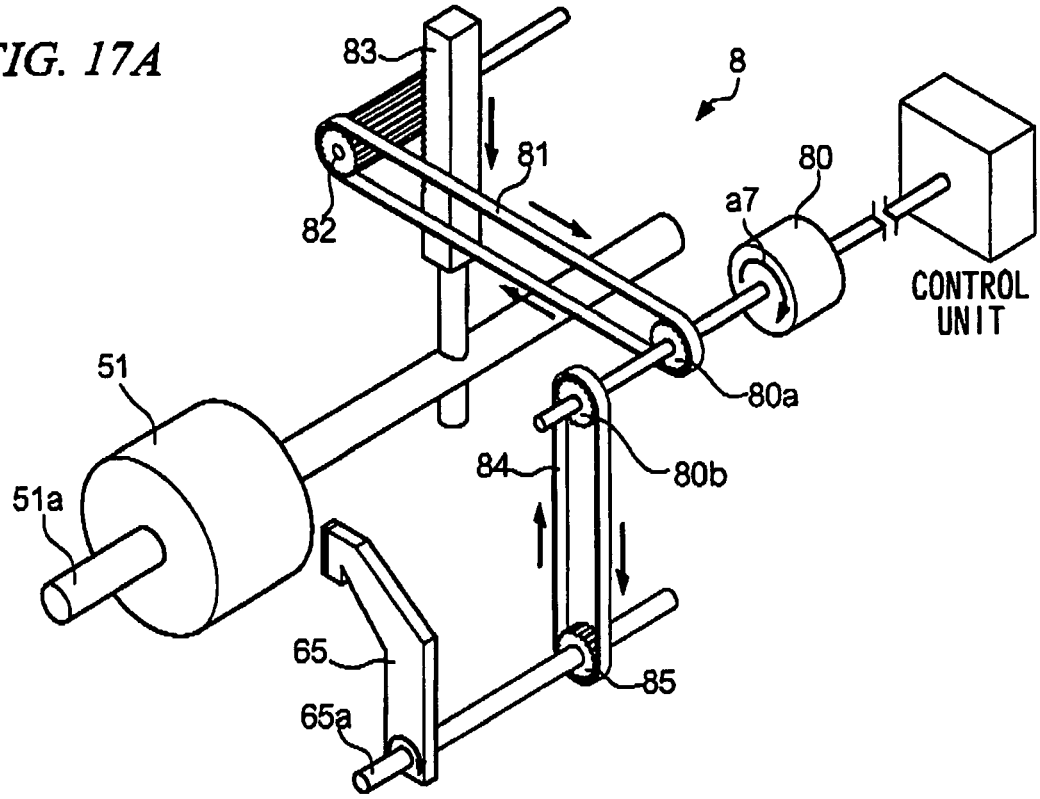
FIGS. 17A and 17B are schematic views that show a power transmission system applicable in the sheet feeding apparatus according to the exemplary embodiments.
Figure 17B:
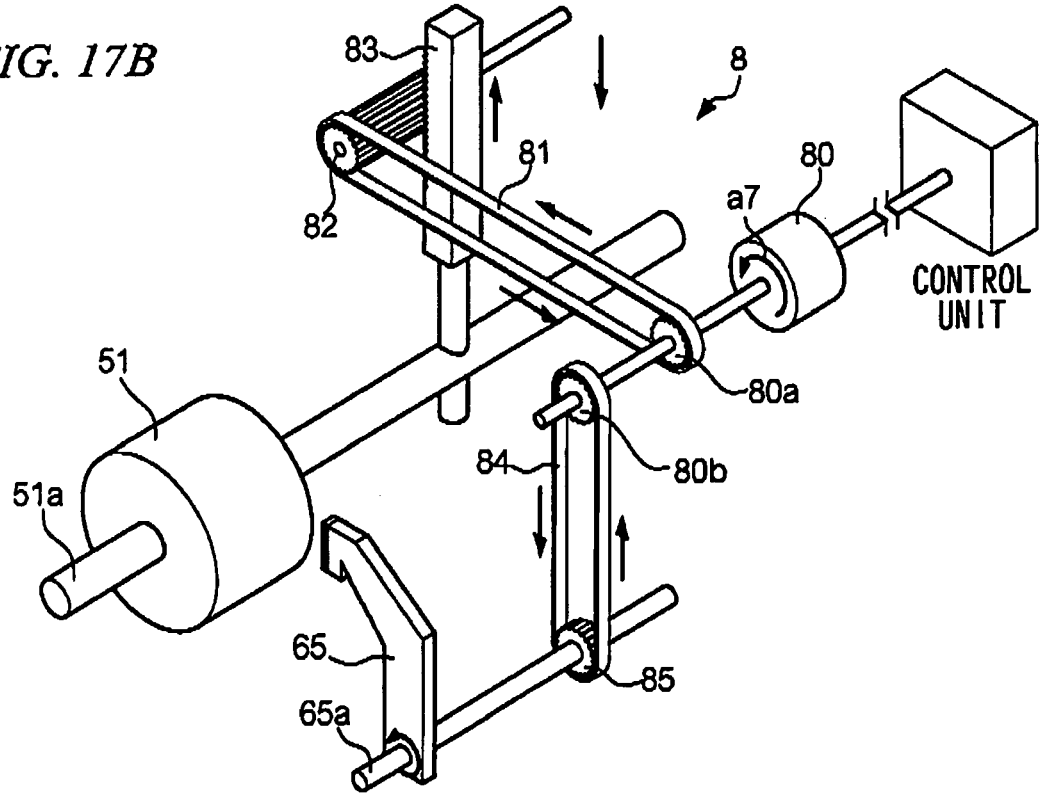

FIGS. 17A and 17B schematically show a power transmission system 8 in such a modified example. In the power transmission system 8, a pinion gear 80a installed to a rotating shaft of a motor 80, and a pinion gear 82 that engages a rack gear 83 installed to a rotating shaft 51*a* of the pickup roller 51 so as to not impair rotation of the rotating shaft 51*a*, are linked by a drive belt 81. Also, a pinion gear 80*b* installed to the rotating shaft of the motor 80, and a pinion gear 85 installed to a pivot shaft 65*a* of the push-back member 65, are linked by a drive belt 84. The drive belts 81 and 84 respectively slide when a force greater than a predetermined threshold value occurs between the pinion gears 80*a* and 80*b*, maintaining a predetermined magnitude for the torque applied to the pinion gears 82 and 85.

When the pickup roller 51 is placed in the ON state, the control portion controls the motor 80 such that driving is performed in the direction of arrow a7 shown in FIG. 17A. As a result, the pickup roller 51 moves downward and presses against the recording sheet P with a predetermined load, and at the same time the push-back member 65 moves until the end 65*b* reaches the separation action point S', stopping in that position. On the other hand, when the pickup roller is placed in the OFF state, the control portion controls the motor 80 such that driving is performed in the direction of arrow a8 in FIG. 17B. As a result, the pickup roller 51 moves upward, and at the same time that it removes the load from the recording sheet P, the push-back member 65 moves until the end 65*b* reaches the end point E, and stops at that position while pushing the fed-together recording sheet P.

In this manner, using the power transmission system 8, the control portion can simultaneously control raising/lowering of the pickup roller 51 and the application of torque to the push-back member 65. Also, a single motor can be provided for raising/lowering of the pickup roller 51 and the application of torque to the push-back member 65.

With the power transmission system 8 described above, when the pickup roller 51 has been placed in the ON state, toque is applied to the push-back member 65 in the direction that the end 65*b* moves to the separation action point S', but a configuration may also be adopted in which the toque becomes zero. In that case, with the pickup roller 51 in the ON state, the push-back member 65 is pushed against the recording sheet P to be transported, and moves in the direction of the separation action point S'.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The exemplary embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A sheet feeding apparatus, comprising:

a transport unit that, among a plurality of recording sheets loaded in a storage unit, transports at least a first recording sheet disposed at an uppermost position in the storage unit;

a separation unit, provided downstream of the transport unit in a transport direction that, when the first recording sheet and one or more other recording sheets are stacked and transported out of the storage unit by the transport unit, causes downstream ends of the other recording sheets in the transport direction locate at a separation action point in a transport path, the separation action point being a contact point between the transport unit and the separation unit, by applying to the other recording sheets a larger force in a direction opposite to the transport direction by the separation unit than a force applied to the other recording sheets in the transport direction by the transport unit, while applying to the first sheet a larger force in the transport direction by the transport unit than a force applied to the first recording sheet in a direction opposite to the transport direction by the separation unit; and a push-back unit that can pivot from the separation action point to a downstream end portion of the storage unit in the transport direction, and pushes back the downstream ends of the other recording sheets to the downstream end portion of the storage unit by applying to the other recording sheets a larger force in the direction opposite to the transport direction by the push-back unit than a force applied to the other recording sheets in the transport direction by the transport unit and the separation unit, while applying to the first recording sheet a smaller force in the direction opposite to the transport direction by the push-back unit than a force applied to the first recording sheet in the transport direction by the transport unit and the separation unit.

2. The sheet feeding apparatus according to claim 1, comprising a push-back force variable unit that alters a magnitude of the force applied by the push-back unit to push back the other recording sheets according to a transport state of the first recording sheet.

3. The sheet feeding apparatus according to claim 1, wherein the transport unit comprises:

a first transport portion that transports at least the first recording sheet such that at least part of the recording sheet protrudes outside from the storage unit, a second transport portion, provided downstream of the first transport unit in the transport direction, that further transports the recording sheet protruding outside from the storage unit in the transport direction; and a control unit;

wherein the control unit performs control of the first transport portion so that the first transport portion does not apply a transport force to the first recording sheet for at least a predetermined time period after a downstream end of the first recording sheet in the transport direction reaches the second transport portion.

4. The sheet feeding apparatus according to claim 3, wherein the force applied by the push-back unit to push back the other recording sheets is smaller than the force applied by the transport unit and the separation unit to the other recording sheets in the transport direction during a period in which the first transport portion applies the transport force to the first recording sheet, and is larger than the force applied by the transport unit and the separation unit to the other recording sheets in the transport direction during a period in which the first transport portion does not apply the transport force to the first recording sheet.

5. The sheet feeding apparatus according to claim 3, comprising a push-back force variable unit that makes a magnitude of the force applied by the push-back unit to push back the other recording sheets during a period in which the first transport portion does not apply the transport force to the first recording sheet larger than a magnitude of the force applied by the push-back unit to push back the other recording sheets in a period in which the first transport portion applies the transport force to the first recording sheet.

6. The sheet feeding apparatus according to claim 3, comprising:

a detection unit that detects that the downstream end of the first recording sheet in the transport direction has arrived at a predetermined position downstream of the second transport portion in the transport direction; wherein the control unit, before the detection unit detects an arrival of the downstream end of the first recording sheet, performs control such that either the first transport unit applies the transport force to the first recording sheet and a driving force is applied to the push-back unit from the end portion of the storage unit toward the separation action point, or no driving force to the push-back unit is applied, and after the detection unit detects the arrival, performs control such that the first transport unit does not apply force to the first recording sheet and driving force is applied to the push-back unit from the separation action point toward the end portion of the storage unit.

7. An image forming apparatus comprising:

the sheet feeding apparatus according to claim 1; and an image forming unit that forms an image on a recording sheet supplied from the sheet feeding apparatus.

8. The image forming apparatus according to claim 7, wherein the sheet feeding apparatus comprises a push-back force variable unit that alters a magnitude of the force applied by the push-back unit to push back the other recording sheets according to a transport state of the first recording sheet.

9. The image forming apparatus according to claim 7, wherein the transport unit comprises:

a first transport portion that transports at least the first recording sheet such that at least part of the recording sheet protrudes outside from the storage unit, a second transport portion, provided downstream of the first transport unit in the transport direction, that further transports the recording sheet protruding outside from the storage unit in the transport direction; and a control unit;

wherein the control unit performs control of the first transport portion so that the first transport portion does not apply a transport force to the first recording sheet for at least a predetermined time period after a downstream end of the first recording sheet in the transport direction reaches the second transport portion.

10. The image forming apparatus according to claim 9, wherein the force applied by the push-back unit to push back the other recording sheets is smaller than the force applied by the transport unit and the separation unit to the other recording sheets in the transport direction during a period in which the first transport portion applies the transport force to the first recording sheet, and is larger than the force applied by the transport unit and the separation unit to the other recording sheets in the transport direction during a period in which the first transport portion does not apply the transport force to the first recording sheet.

11. The image forming apparatus according to claim 9, wherein the sheet feeding apparatus comprises a push-back force variable unit that makes a magnitude of the force applied by the push-back unit to push back the other recording sheets during a period in which the first transport portion does not apply the transport force to the first recording sheet larger than a magnitude of the force applied by the push-back unit to push back the other recording sheets in a period in which the first transport portion applies the transport force to the first recording sheet.

12. The image forming apparatus according to claim 9, wherein the sheet feeding apparatus comprises:

a detection unit that detects that the downstream end of the first recording sheet in the transport direction has arrived at a predetermined position downstream of the second transport portion in the transport direction; wherein the control unit, before the detection unit detects an arrival of the downstream end of the first recording sheet, performs control such that either the first transport unit applies the transport force to the first recording sheet and a driving force is applied to the push-back unit from the end portion of the storage unit toward the separation action point, or no driving force to the push-back unit is applied, and after the detection unit detects the arrival, performs control such that the first transport unit does not apply force to the first recording sheet and driving force is applied to the push-back unit from the separation action point toward the end portion of the storage unit.

* * * * *